US007841614B2

(12) United States Patent
Damiani et al.

(10) Patent No.: US 7,841,614 B2
(45) Date of Patent: Nov. 30, 2010

(54) SAFETY BINDING

(75) Inventors: Laurent Damiani, Villaz (FR); Pierre Desarmaux, Evires (FR); Philippe Miette, Annecy le Vieux (FR)

(73) Assignee: Saloman S.A.S., Metz-Tessy (FR)

( * ) Notice: Subject to any disclaimer, the term of this patent is extended or adjusted under 35 U.S.C. 154(b) by 783 days.

(21) Appl. No.: 11/256,962

(22) Filed: Oct. 25, 2005

(65) Prior Publication Data

US 2007/0090627 A1 Apr. 26, 2007

(51) Int. Cl.
*A63C 9/088* (2006.01)

(52) U.S. Cl. ..... 280/611; 280/623

(58) Field of Classification Search ..... 280/611–637, 280/DIG. 12, DIG. 13
See application file for complete search history.

(56) References Cited

U.S. PATENT DOCUMENTS

| | | | | | |
|---|---|---|---|---|---|
| 4,121,854 | A | | 10/1978 | Cornu | |
| 4,160,555 | A | | 7/1979 | Salomon | |
| 4,291,894 | A | * | 9/1981 | D'Antonio et al. | 280/612 |
| 4,383,702 | A | | 5/1983 | Salomon | |
| 4,444,411 | A | * | 4/1984 | Svoboda et al. | 280/611 |
| 4,563,021 | A | * | 1/1986 | Klubitschko | 280/612 |
| 4,589,673 | A | * | 5/1986 | Dimier et al. | 280/630 |
| 4,640,026 | A | * | 2/1987 | Kirsch | 280/613 |
| 4,657,278 | A | * | 4/1987 | Klubitschko | 280/612 |
| 4,776,608 | A | * | 10/1988 | Caillat et al. | 280/634 |
| 4,851,706 | A | * | 7/1989 | D'Antonio | 307/119 |
| 5,085,453 | A | * | 2/1992 | Bildner | 280/612 |
| 5,114,171 | A | * | 5/1992 | D'Antonio | 280/612 |
| 5,150,913 | A | * | 9/1992 | Hoelzl | 280/612 |
| 5,188,387 | A | * | 2/1993 | Ruffinengo | 280/612 |
| 5,213,358 | A | * | 5/1993 | Badura | 280/612 |
| 5,294,144 | A | * | 3/1994 | Stepanek et al. | 280/612 |
| 5,411,283 | A | * | 5/1995 | Nowak et al. | 280/618 |
| 5,498,017 | A | * | 3/1996 | Rohrmoser | 280/633 |
| 5,743,550 | A | * | 4/1998 | Frohwein | 280/612 |
| 5,820,155 | A | * | 10/1998 | Brisco | 280/607 |
| 6,007,086 | A | * | 12/1999 | Hopkins | 280/612 |
| 6,659,494 | B1 | * | 12/2003 | Martin | 280/612 |
| 7,025,373 | B2 | * | 4/2006 | Holzer | 280/633 |
| 7,063,345 | B2 | * | 6/2006 | Holzer | 280/611 |
| 7,073,812 | B2 | * | 7/2006 | Rigal et al. | 280/611 |
| 7,104,564 | B2 | * | 9/2006 | Martin et al. | 280/625 |
| 7,431,323 | B2 | * | 10/2008 | Holzer et al. | 280/625 |
| 2004/0113393 | A1 | * | 6/2004 | Rigal et al. | 280/631 |
| 2004/0145153 | A1 | * | 7/2004 | Holzer | 280/611 |
| 2004/0145154 | A1 | * | 7/2004 | Holzer | 280/611 |
| 2005/0167950 | A1 | * | 8/2005 | Martin et al. | 280/618 |
| 2005/0194764 | A1 | * | 9/2005 | Bluemel | 280/611 |
| 2006/0145455 | A1 | * | 7/2006 | Holzer et al. | 280/625 |
| 2006/0192365 | A1 | * | 8/2006 | Ettlinger et al. | 280/611 |
| 2007/0080518 | A1 | * | 4/2007 | Carvajal | 280/611 |
| 2007/0170695 | A1 | * | 7/2007 | Damiani et al. | 280/617 |
| 2007/0170696 | A1 | | 7/2007 | Damiani et al. | |

* cited by examiner

*Primary Examiner*—S. Joseph Morano
*Assistant Examiner*—Jacob Meyer
(74) *Attorney, Agent, or Firm*—Greenblum & Bernstein, P.L.C.

(57) ABSTRACT

A safety binding device for retaining a boot on a gliding board including: a module for detecting the forces to which the boot is subjected, the detection module generating an analog signal proportional to the forces; a decision module integrating a mechanism to convert the analog signal into digital information, and a mechanism to process the digital information according to a release-controlling algorithm depending upon the time and parameters determined by the user's characteristics and/or snow conditions and/or type of sports practice, the processing mechanism generating a control signal; and further including a mechanical actuation module controlled by the control signal and allowing the boot to be released.

25 Claims, 5 Drawing Sheets

1
2
3
4
DETECTION
5
8
DECISION
6
9
ACTUATION
7

SAFETY BINDING

BACKGROUND OF THE INVENTION

1. Field of the Invention

The instant invention relates to a safety device for binding a boot to a gliding board.

Various safety devices for binding a boot to a gliding board are already known, particularly in the fields of alpine skiing and snowboarding.

2. Description of Background and Relevant Information

Traditionally and for many years, safety bindings in alpine skiing have included a front stop and a rear heel piece. The front stop and the heel piece hold the ski boot therebetween. The front stop and the heel piece trigger and release the ski boot when either one of them is subjected to forces that exceed a certain threshold. The release threshold can be modified by adjusting the pretension of the springs positioned in the front stop and the heel piece. However, this adjustment is done once and for all before each use and cannot be easily modified during the sports practice without having to use tools, such as screwdrivers. Consequently, such a binding cannot be self-adaptable.

SUMMARY OF THE INVENTION

An object of the present invention is to provide a safety binding for retaining a boot on a gliding board, such as a ski or a snowboard, which makes it possible to overcome the limitations of the known prior art devices.

Such object is achieved by the provision of a safety binding for retaining a boot on a gliding board, which includes at least the following:

- a mechanism to detect the forces to which the boot is subjected, such detection mechanism providing an analog signal that is proportional to the forces;
- a mechanism to convert the analog signal into digital information;
- a mechanism to process the digital information according to a release-controlling algorithm that is a function of time and parameters determined by the user's characteristics and/or snow conditions and/or the type of sports activity and/or any other parameters such as speed, vibrations, etc., the processing mechanism generating a control signal;
- a mechanism to create a mechanical actuation controlled by the control signal to allow release of the boot.

The detection mechanism is constituted by a detection module, whereby the conversion mechanism and the processing mechanism are integrated within a decision module, and whereby the actuation mechanism includes an actuation module.

Advantageously, the analog signal provided by the sensor is converted into a digital signal, which is processed by a digital decision module. Digital processing has the advantage of not being sensitive to temperature, of being easily reprogrammable, and of allowing data storage and data export. Furthermore, from an industrial standpoint, the use of a digital module facilitates upgrading while reducing costs.

BRIEF DESCRIPTION OF DRAWINGS

The invention will be better understood from the description that follows, with reference to the annexed schematic drawings, in which.

DETAILED DESCRIPTION OF THE INVENTION

Figure 1:
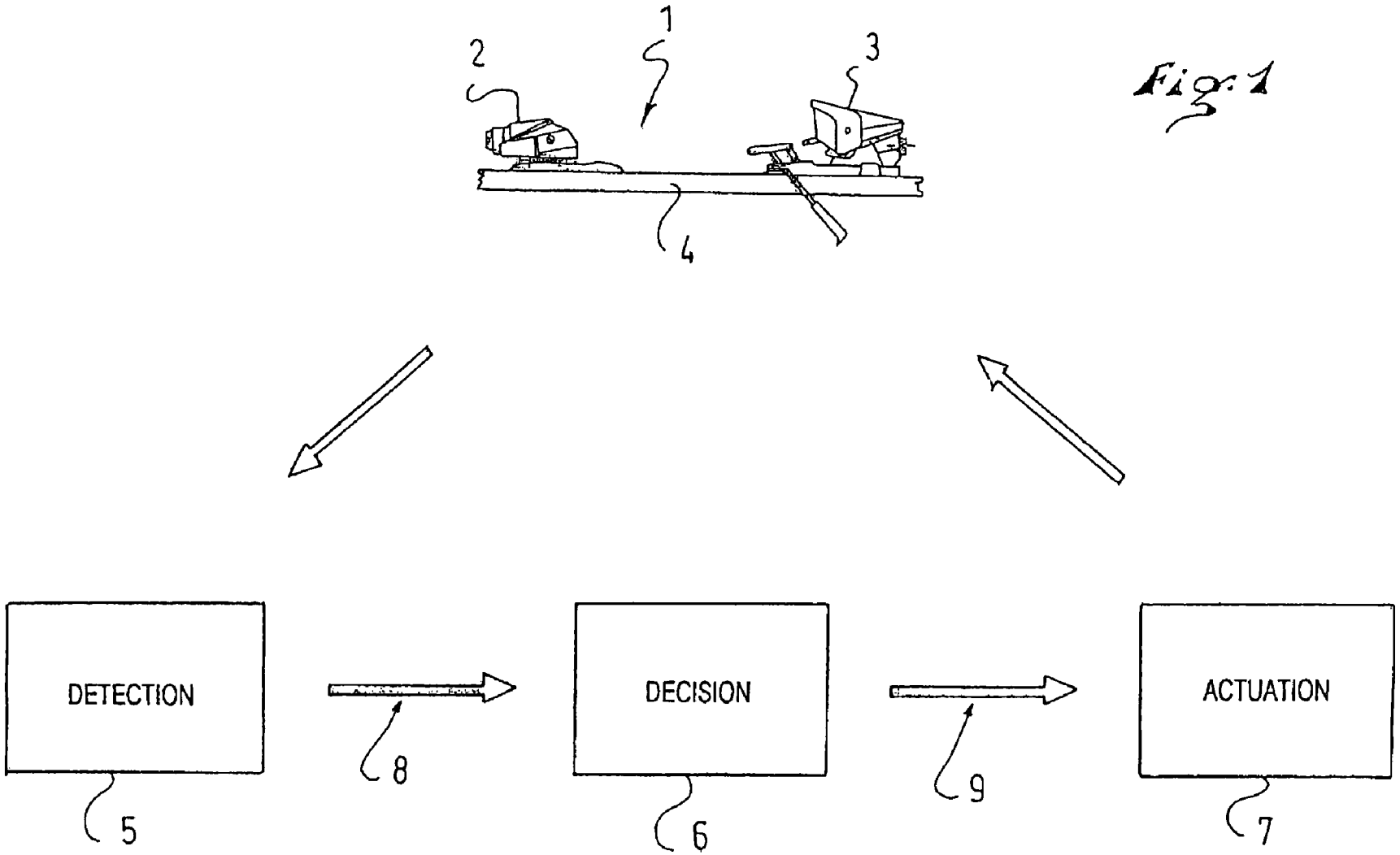
FIG. 1 is a functional diagram of the entire device.

FIG. 1 shows a functional diagram of a binding device according to the invention. The binding device 1 includes a front stop 2 and a rear heel piece 3, both attached to the gliding board 4. The device further includes a detection module 5, a decision module 6, and an actuation module 7.

The detection module 5, or detector, evaluates the forces to which the various parts of the binding are subjected. This evaluation is carried out by means of stress gauges, or sets of stress gauges, positioned on one or several equipped bars or plates or other suitable substrate(s). One or all of the equipped substrates are positioned between the binding and the gliding board, such as between the gliding board and either or both of the front stop and the heel piece of the binding. The use of stress gauges is non-limiting within the framework of the invention and any other type of sensor could be used. Furthermore, it is also possible to attach the sensors directly inside the structure of the binding itself, such as on the wings of the front stop, or on the jaw of the rear binding, for example. U.S. Pat. No. 4,160,555, U.S. Pat. No. 4,383,702, and U.S. Patent Publication No. 2004/0113393, all commonly owned herewith, the disclosures of which are hereby incorporated by reference thereto in their entireties, disclose examples of ski bindings utilizing stress gauges in systems for detecting and electronically processes stresses.

The detection module 5 generates one or several analog signals 8 in the form of electrical voltage proportional to the forces to which the binding is subjected during use. In the case where the analog signals are coupled signals, one will incorporate a decoupling matrix in the decision module 6.

In a simple configuration, a single sensor including a plurality of stress gauges can be used, but its position would be such that it would allow for the detection of forces in several directions. More complete configurations could use a greater number of stress gauges, each one of them generating an analog signal in the form of a voltage.

The choice of the stress gauge as a sensor for the detection module is non-limiting since it could be replaced with other types of sensors, such as piezoelectric sensors.

The analog signal 8 is transmitted to the decision module 6, which generates an electric binary control signal 9, that is, a two-state signal: high and low.

The binary control signal 9 is transmitted to the actuation module 7, which controls the release of the binding when the binary signal 9 in the high state.

The three modules, namely, the detection module, the decision module, and the actuation module, can be fed by a common source of energy such as in the form of a battery, a solar cell, or a piezoelectric element, for example.

Figure 2:
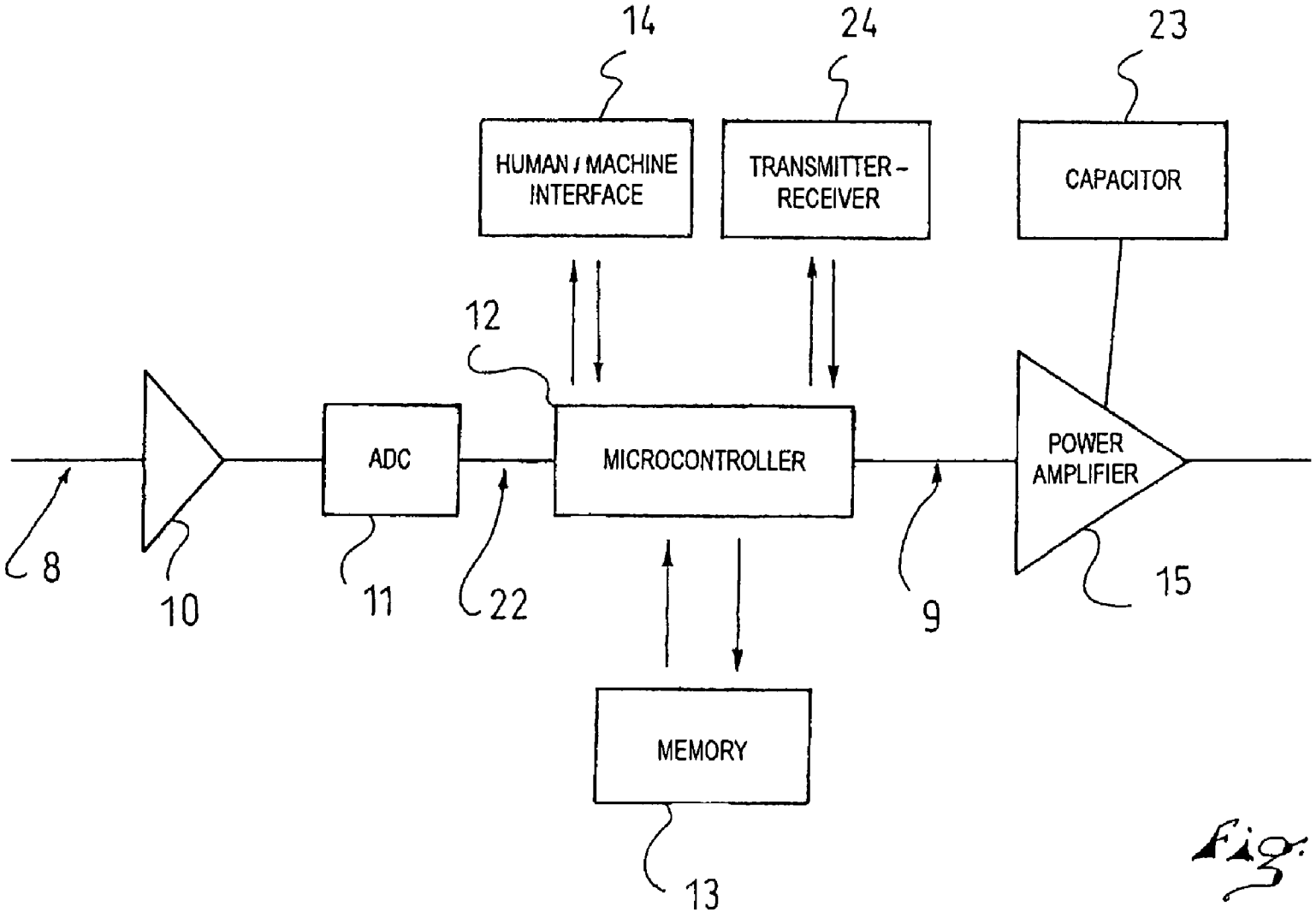
FIG. 2 is a functional diagram of the decision module.

The decision module 6 is shown in FIG. 2. It includes an amplifier 10, which receives the analog signal 8, configures it and transmits it to the ADC 11 (analog-to-digital converter).

The ADC 11 provides the microcontroller 12 with digital information 22, corresponding to the magnitude of the force detected by the detection module 5.

The microcontroller 12 constitutes the central part of the decision module 6. It is connected to a memory 13 that holds, among other things, the release-controlling algorithm. The algorithm determines whether to allow release of the boot depending upon the force to which the binding 1 is subjected, the period of time during which the forces are applied, and other parameters.

The microcontroller 12 is also connected to a man/machine interface 14 that includes a display and at least one pushbutton (or other manipulable input device). This interface is used to allow the user or the technician to modify some parameters, such as the skier's weight, level of experience, the snow conditions, the state of the ski run, etc. This man/machine interface can simply be a potentiometer.

The microcontroller 12 can also be connected to a transmitter/receiver to allow for a wireless connection with a computer. The wireless connection can be used for the modification of parameters or to update the release-controlling algorithm.

The wireless connection could also be used for transmitting a log of successive releases from the microcontroller 12 to the receiving computer.

The wireless connection could also transmit the entire history.

Depending upon the analog signal 8 entering the decision module 6, the release-controlling algorithm, and certain parameters, the microcontroller 12 (or processor) generates a binary signal 9, which is amplified by a power amplifier 15 fed by a capacitor 23.

The binary signal thus amplified controls the actuation module 7, or actuator, which in turn places the binding 1 in a release mode, i.e., thereby allowing the boot to be released from the binding.

The motive energy of the actuation module 7, for releasing the binding, can be hydraulic (pump), pneumatic (compressed gas cartridge), pyrotechnical (detonating cartridge), electric (motor, electromagnet), or mechanical (spring). As examples, U.S. Pat. No. 4,121,854 discloses a binding using a pyrotechnic-type release; U.S. Pat. No. 5,085,453 discloses a binding using an electromagnetic-type release; and U.S. Patent Application Publication No. 2004/0113393 discloses a binding using a pneumatic-type release, the disclosures of which documents are hereby incorporated by reference thereto in their entireties.

According to the invention, the actuation module can also include an arrangement that resets the binding, following a release.

Figure 3:
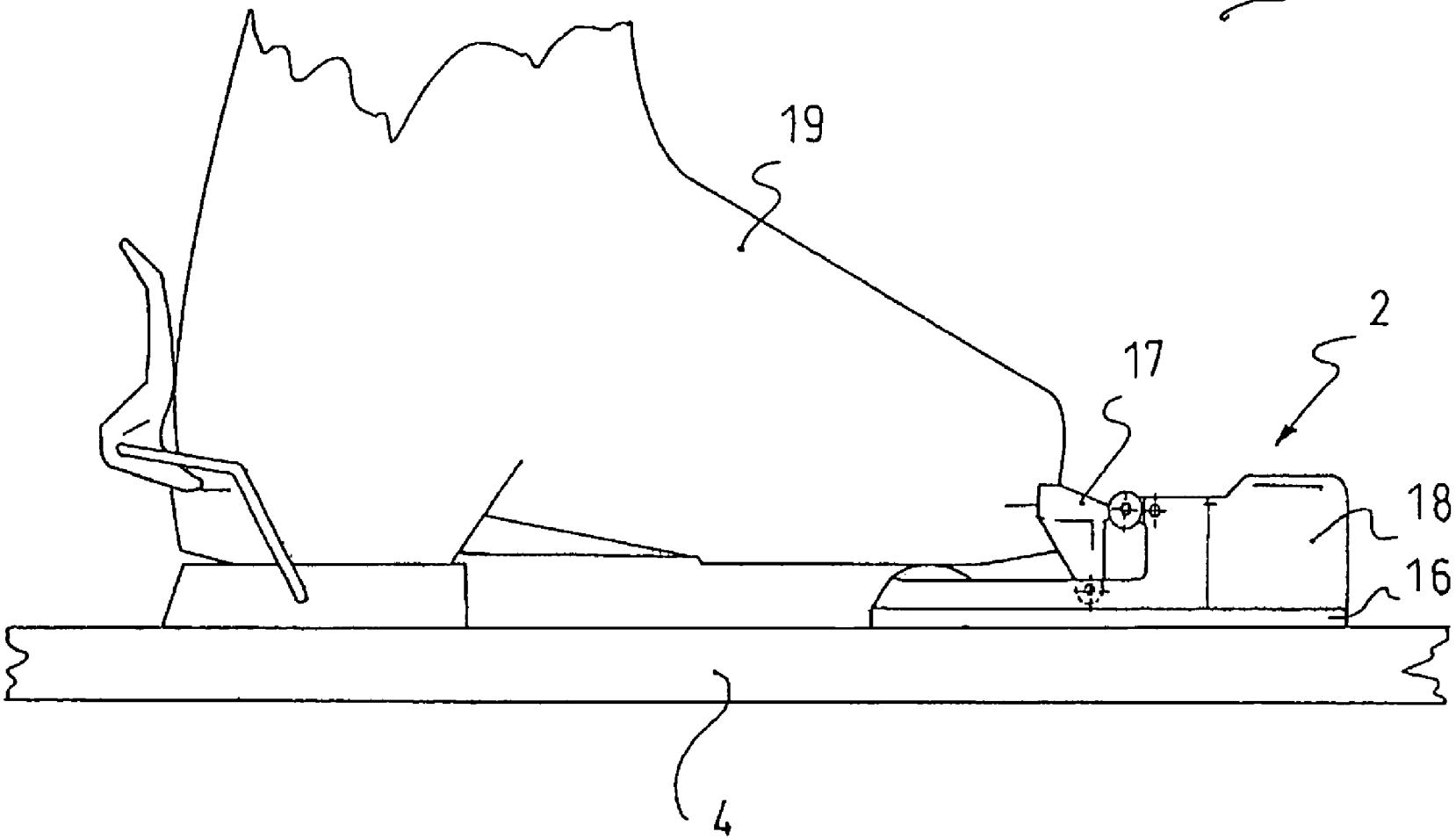
FIG. 3 is a view of a first embodiment of the invention.

FIG. 3 shows a first embodiment of the invention for a binding of a type that includes a releasable retaining element, or binding, in the form of a front stop 2 equipped with a pivotable jaw 17, and operated by a pneumatic mechanism.

An equipped substrate 16, on which the detection module sensors are mounted, is positioned between the gliding board 4 and the stop 2 (front binding). As seen in FIG. 3, the sensor-equipped substrate 16 is attached at one surface to the stop 2 and at another surface to the gliding board 4. This sensor-equipped substrate 16 allows for all of the forces transmitted between the gliding board 4 and the boot 19 to be detected and then compared with the release-controlling algorithm by the decision module 6.

Both the decision module 6 and the actuation module 7 are positioned beneath the cover 18 of the stop 2.

Figure 4:
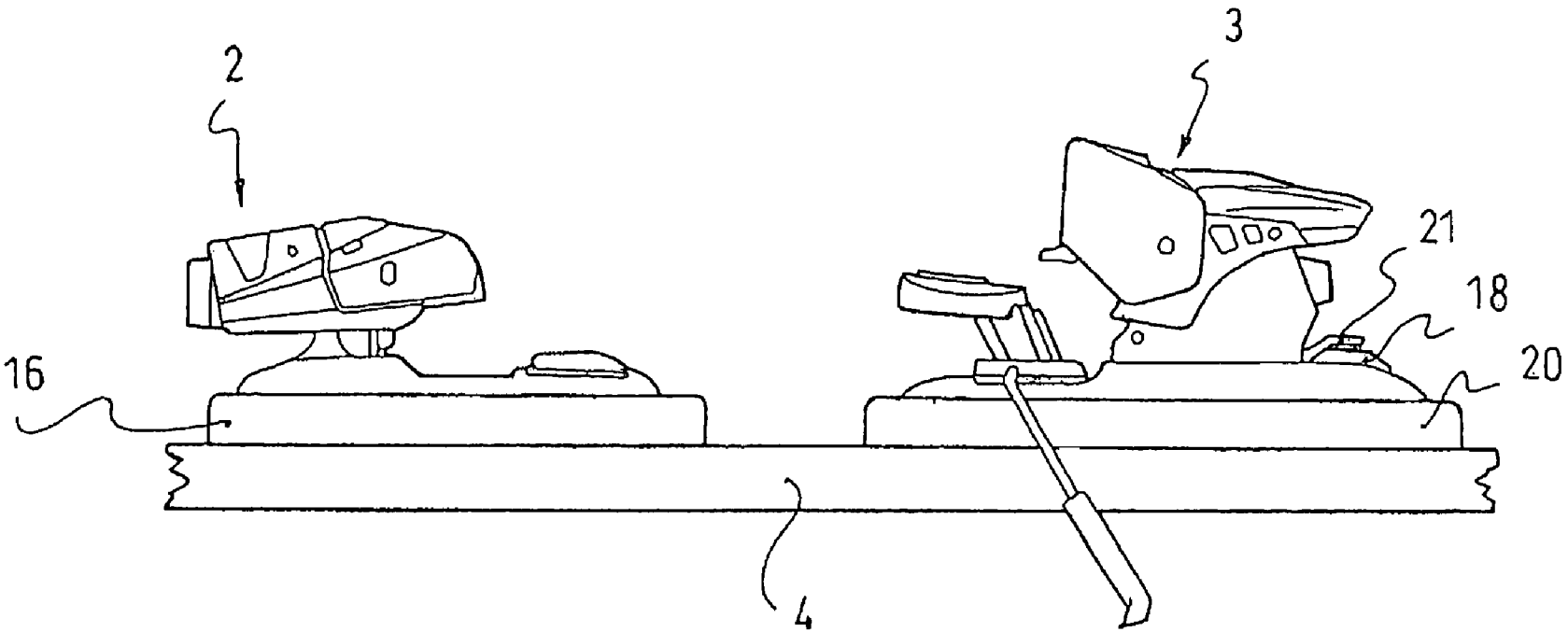
FIG. 4 is a view of a second embodiment of the invention.

FIG. 4 shows a second embodiment of the invention for a binding 1 of a type having two releasable retaining elements, namely a front stop 2 and a heel piece 3.

The mechanical operation of the binding is well-known to those skilled in the art and has not be described in further detail herein. One can simply note that the front stop 2 mainly releases when the forces between the boot and the gliding board have a component in a plane parallel to the gliding board that is greater than a first given threshold, the latter being determined by adjusting the spring located inside the stop 2. The heel piece 3 mainly releases when the same forces have a component in the vertical longitudinal plane of the gliding board that is greater than a second given threshold, the latter being determined by adjusting a spring positioned inside the heel piece 3.

The heel piece 3 is attached to the gliding board 4 through the intermediary of a longitudinal slide 20, whereby the position of the heel piece 3 can be adjusted to accommodate boots of different lengths. The heel piece 3 is kept in position on the slide by means of a latch, the lever 21 of which is visible in the rear of the heel piece.

The substrate 16, on which the detection module sensors are mounted, is positioned between the gliding board 4 and the stop 2. As seen in FIG. 4, the sensor-equipped substrate 16 is attached at one surface to the stop 2 and at another surface to the gliding board 4. The substrate 16 allows for all of the forces transmitted between the gliding board 4 and the boot 19 to be detected and then compared with the release-controlling algorithm by the decision module 6.

Both the decision module 6 and the actuation module 7 are housed beneath a cover 18 at the rear of the heel piece 3. The actuation module 7 acts on the lever 21 of the latch in order to free the longitudinal translational movement of the heel piece 3.

Depending upon the forces to which the sensor-equipped substrate is subjected and depending upon the release-controlling algorithm stored in the memory 13 of the decision module 6, the heel piece can move away from the stop 2, resulting in releasing the boot from the binding.

In addition to the mechanical releases from the stop 2 and from the heel piece 3, the user also benefits from a release controlled as a function of a release algorithm managed electronically and digitally and therefore completely optimal and adaptable. That is, the user can be released from his/her skis by means of either a first release arrangement upon the exertion of a release force greater than a threshold force exerted by a spring, e.g., as well as by means of a second release arrangement controlled by a digital electronic release algorithm.

Figure 5:
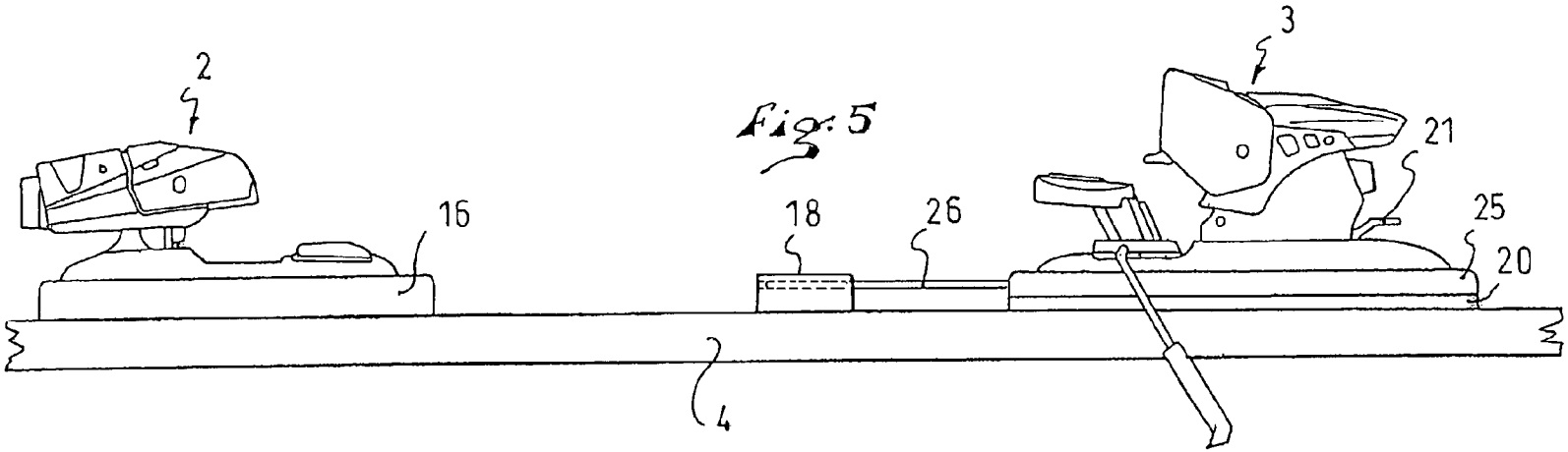
FIG. 5 is a view of a third embodiment of the invention in the closed position.
Figure 6:
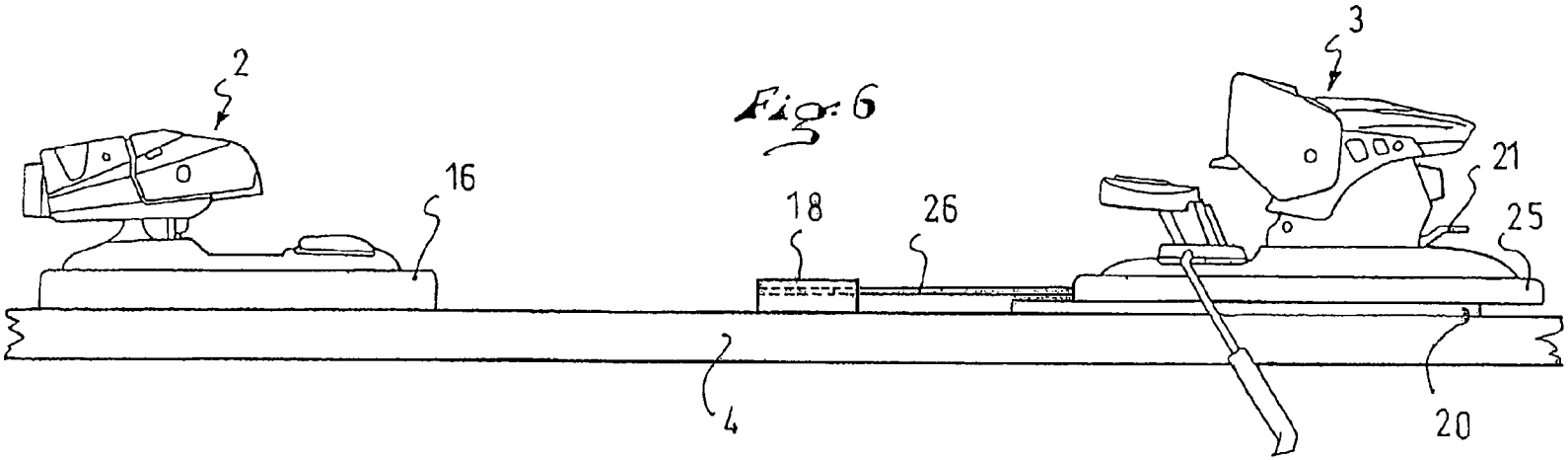
FIG. 6 is a view of a third embodiment of the invention in the open position.

FIG. 5 and FIG. 6 show a third embodiment of the invention for a binding 1 of a type including two releasable retaining elements, namely a front stop 2 and a heel piece 3.

Similar to the example shown in FIG. 4, the mechanical operation of the binding is well-known and has not been described in further detail. One can simply note that the front stop 2 mainly releases when the forces between the boot and the gliding board have a component in a plane parallel to the gliding board that is greater than a first given threshold, the latter being determined by adjusting the spring located inside the front stop 2. The heel piece 3 mainly releases when the same forces have a component in the vertical longitudinal plane of the gliding board that is greater than a second given threshold, the latter being determined by adjusting a spring positioned inside the heel piece 3.

The heel piece 3 is attached to a plate 25. It can slide relative to this plate 25 to allow for a length adjustment, but also to ensure the backward movement of the heel piece when, while practicing, the gliding board is flexed. It is kept in position in the plate 25 by means of a latch, the lever 21 of which is visible at the rear of the heel piece.

The plate 25 is affixed to the gliding board by means of a slide 20 inside which it can slide longitudinally.

A substrate 16, on which the detection module sensors are mounted, is positioned between the gliding board 4 and the front stop 2. As seen in FIGS. 5 and 6, the sensor-equipped substrate 16 is attached at one surface to the stop 2 and at another surface to the gliding board 4. This instrumented substrate 16 allows for all of the forces transmitted between the gliding board 4 and the boot to be detected and then compared with the release-controlling by the decision module 6.

Both the decision module 6 and the actuation module 7 are housed beneath a cover 18 positioned between the stop and the heel piece. The actuation module 7 acts on a rod 26, which pushes the plate 25, thus generating the longitudinal translational movement of the heel piece 3.

Depending upon the forces to which the instrumented substrate 16 is subjected and depending upon the release-controlling algorithm stored in the memory 13 of the decision module 6, the heel piece can move away from the stop 2, resulting in freeing the boot from the binding.

In addition to the mechanical releases from the stop 2 and from the heel piece 3, the user also benefits from a release controlled as a function of a release-controlling algorithm managed electronically and digitally and therefore completely optimal and adaptable. That is, the user can be released from his/her skis by means of either a first release arrangement upon the exertion of a release force greater than a threshold force exerted by a spring, e.g., as well as by means of a second release arrangement controlled by a digital electronic release mechanism. In the embodiments of FIGS. 4-6, release is achieved with the first release arrangement by means of a horizontal component of movement (pivotal, e.g.) or an upward movement of a part of the binding (i.e., that of either the front stop 2 or the heel piece 3, respectively) and with the second release arrangement by means of movement different from those of the first release arrangement (i.e., such as a longitudinal translation)

The invention is not limited to the several examples described hereinabove and could be implemented for any safety device for binding a boot to a gliding board.

LIST OF ELEMENTS

1—binding
2—front stop
3—heel piece
4—gliding board
5—detection module
6—decision module
7—actuation signal
8—analog signal
9—binary control signal
10—amplifier
11—ADC
12—microcontroller
13—memory
14—man/machine interface
15—power amplifier
16—equipped substrate
17—jaw
18—cover
19—boot
20—slide
21—lever
22—digital information
23—capacitor
24—transmitter/receiver module
25—plate
26—rod

The invention claimed is:

1. Safety binding for retaining a boot of a user on a gliding board, said binding comprising:

a detector to detect forces to which the boot is subjected, said detector generating an analog signal proportional to said forces;

a converter to convert said analog signal into digital information;

a processor to process said digital information according to a release-controlling algorithm that is a function of duration of said forces and a function of parameters determined by at least one of the following: characteristics of the user, snow conditions, and type of sports practice, said processor thereby generating a control signal;

an actuator to create a mechanical actuation controlled by said control signal, transmission of said control signal to said actuator placing the binding in a release mode to release the boot from the binding;

a mechanical mechanism structured and arranged to apply a threshold retention force to the boot to retain the boot on the gliding board;

said mechanical mechanism further structured and arranged to release the boot, independent of said control signal, upon exertion of a release force by the boot greater than said threshold retention force.

2. Safety binding according to claim 1, wherein:

said detector comprises a detection module;

said converter and said processor are integrated within a decision module;

said actuator comprises an actuation module.

3. Safety binding according to claim 2, wherein:

said binding comprises at least one releasable retaining element;

said detector comprises a first sensor-equipped substrate attached at one surface to said releasable retaining element and attached at a second surface to said gliding board.

4. Safety binding according to claim 2, wherein:

said binding comprises a front stop and a heel piece;

said detector comprises a first sensor-equipped substrate, attached at a first surface to said front stop and at a second surface to said gliding board, and a second sensor-equipped substrate attached at a first surface to said heel piece and at a second surface to said gliding board.

5. Safety binding according to claim 2, wherein:

said binding comprises binding elements constituted by a front stop and a heel piece;

said detector comprises sensors attached directly within a structure of said binding.

6. Safety binding according to claim 1, wherein:

said actuator comprises a pneumatic source of energy.

7. Safety binding according to claim 1, wherein:

the actuator comprises a mechanical source of energy.

8. Safety binding according to claim 1, further comprising:

an interface module comprising a structure for displaying and enabling a modification of parameters of the digital information processor.

9. Safety binding according to claim 8, wherein:

said interface module comprises a display and at least one manipulable input device.

10. Safety binding according to claim 8, wherein:

said interface module comprises a potentiometer.

11. Safety binding according to claim 8, wherein:

said interface module comprises a transmitter/receiver.

12. Safety binding according to claim 1, further comprising:

a mechanism to reset said actuator.

13. Safety binding according to claim 2, wherein:

said binding comprises a front stop and a heel piece;

said detector comprises a first sensor-equipped substrate, attached at a first surface to said front stop and at a second surface to said gliding board.

14. Safety binding according to claim 2, wherein:

said binding comprises a front stop and a heel piece;

said detector comprises a first sensor-equipped substrate, attached at a first surface to said heel piece and at a second surface to said gliding board.

15. Safety binding according to claim 1, wherein:

said mechanical mechanism comprises a spring for applying said threshold retention force.

16. Safety binding according to claim 1, wherein:

said mechanical mechanism includes a part movable, to release the boot, in a first direction having a horizontal component or a vertical component;

said release mode placed by said actuator controlled by said control signal, to release the boot, consists of movement in a second direction different from said first direction.

17. Safety binding according to claim 16, wherein:

said first direction is an upward movement and said second direction is a longitudinal translation.

18. A safety binding for retaining a boot of a user on a gliding board, said binding comprising:

a releasable retaining element adapted to engage a portion of the boot to retain the boot on the gliding board;

a first release arrangement comprising a mechanical mechanism for applying a threshold retention force to the releasable retaining element and for placing the binding in a release mode upon exertion of a release force by the boot greater than said threshold retention force;

a second release arrangement for placing the binding in a release mode by means of a mechanical actuation controlled by a digital electronic release algorithm, said second arrangement comprising:

a force-detection mechanism to detect forces to which the boot is subjected, said detection mechanism generating an analog signal proportional to said forces;

an analog-digital mechanism to convert said analog signal into digital information;

a digital processing mechanism to process said digital information and to generate a control signal according to a release-controlling algorithm, said algorithm being a function of the following: a force applied to binding, an amount of time a force is applied, and additional parameters comprising at least one of the following: characteristics of the user, snow conditions, and type of sports practice;

a mechanical-actuation mechanism to create a mechanical actuation controlled by said control signal, said mechanical actuation allowing release of the boot from the binding.

19. A safety binding according to claim 18, wherein:

said mechanical mechanism of said first release arrangement comprises a spring for applying said threshold retention force.

20. A safety binding according to claim 18, wherein:

said first release arrangement is a mechanical release arrangement for placing the binding in a release mode not controlled by the digital electronic release algorithm.

21. A safety binding according to claim 18, further comprising:

an interface module comprising a structure for displaying and enabling a modification of parameters of the digital information processor.

22. A safety binding according to claim 18, wherein:

said releasable retaining element includes a part movable, for release of the boot by the first release arrangement, in a first direction having a horizontal component or a vertical component;

said mechanical actuation created by said mechanical-actuation mechanism of the second release arrangement consists of a second direction of movement of said part of said releasable retaining element, said second direction being different from said first direction.

23. A safety binding according to claim 22, wherein:

said first direction is an upward movement and said second direction is a longitudinal translation.

24. A safety binding for retaining a boot of a user on a gliding board, said binding comprising:

a detector to detect forces to which the boot is subjected, said detector generating an analog signal proportional to said forces;

a converter to convert said analog signal into digital information;

a processor to process said digital information according to a release-controlling algorithm that is a function of duration of said forces and a function of parameters determined by at least one of the following: characteristics of the user, snow conditions, and type of sports practice, said processor thereby generating a control signal;

an actuator to create a mechanical actuation controlled by said control signal, transmission of said control signal to said actuator placing the binding in a release mode to release the boot from the binding;

a mechanical mechanism structured and arranged to apply a threshold retention force to the boot to retain the boot on the gliding board;

said mechanical mechanism further structured and arranged to release the boot, independent of said control signal, upon exertion of a release force by the boot greater than said threshold retention force;

an interface module comprising a structure for displaying and enabling a modification of parameters of the digital information processor;

said mechanical mechanism including a part movable, to release the boot, in a first direction having a horizontal component or a vertical component;

said release mode placed by said actuator controlled by said control signal, to release the boot, consisting of a second direction different from said first direction.

25. A safety binding according to claim 24, wherein:

said first direction is an upward movement and said second direction is a longitudinal translation.

* * * * *